US009285754B2

(12) United States Patent
Nodera et al.

(10) Patent No.: US 9,285,754 B2
(45) Date of Patent: Mar. 15, 2016

(54) IMAGE FORMING APPARATUS

(71) Applicants: Kentaroh Nodera, Kanagawa (JP); Hiromichi Ninomiya, Kanagawa (JP); Masahiko Shakuto, Kanagawa (JP); Takuma Iwasaki, Tokyo (JP); Hajime Teraji, Kanagawa (JP); Daisuke Sawada, Kanagawa (JP)

(72) Inventors: Kentaroh Nodera, Kanagawa (JP); Hiromichi Ninomiya, Kanagawa (JP); Masahiko Shakuto, Kanagawa (JP); Takuma Iwasaki, Tokyo (JP); Hajime Teraji, Kanagawa (JP); Daisuke Sawada, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/794,171

(22) Filed: Jul. 8, 2015

(65) Prior Publication Data

US 2016/0033922 A1 Feb. 4, 2016

(30) Foreign Application Priority Data

Jul. 30, 2014 (JP) ..... 2014-154411

(51) Int. Cl.
*G03G 21/00* (2006.01)
*G03G 15/16* (2006.01)

(52) U.S. Cl.
CPC ..... *G03G 21/0005* (2013.01); *G03G 15/16* (2013.01)

(58) Field of Classification Search
CPC ..... G03G 15/0266; G03G 15/5062; G03G 5/0614; G03G 5/0668; G03G 5/0672; G03G 5/14704; G03G 5/14708; G03G 5/14717
See application file for complete search history.

(56) References Cited

U.S. PATENT DOCUMENTS

2001/0024580 A1* 9/2001 Kusunose ..... G03G 21/1814 399/111
2003/0224258 A1* 12/2003 Bhattacharya ..... G03G 13/013 430/18

FOREIGN PATENT DOCUMENTS

| | | |
|---|---|---|
| JP | 2003-122065 | 4/2003 |
| JP | 2011-112818 | 6/2011 |
| JP | 5327569 | 8/2013 |

* cited by examiner

*Primary Examiner* — Roy Y Yi
(74) *Attorney, Agent, or Firm* — Harness, Dickey & Pierce, P.L.C.

(57) ABSTRACT

An image forming apparatus includes: an image bearer on which a latent image is formed and developed into a toner image; a transfer member that is arranged so as to come in contact with or face the image bearer to form a transfer position; a cleaning unit that removes and collects untransferred toner; a guide member that guides conveyance of the recording medium; a neutralizing light source that irradiates a position downstream of the transfer position and upstream of the cleaning unit in a running direction of the image bearer with neutralizing light which is incident on and reflected by the recording medium sent out from the transfer position and/or the guide member; and a shielding member that blocks light such that the image bearer is not irradiated directly with a part or whole of neutralizing light emitted from the neutralizing light source.

14 Claims, 5 Drawing Sheets

IMAGE FORMING APPARATUS

CROSS-REFERENCE TO RELATED APPLICATIONS

The present application claims priority to and incorporates by reference the entire contents of Japanese Patent Application No. 2014-154411 filed in Japan on Jul. 30, 2014.

BACKGROUND OF THE INVENTION

1. Field of the Invention

The present invention relates to an electrophotography image forming apparatus, such as a copier, a printer, a facsimile machine, or a multifunction peripheral including the copier, the printer, and the facsimile machine, and in particular, to an image forming apparatus including a neutralizing light source for neutralizing a surface potential on an image bearer, such as a photoconductor drum.

2. Description of the Related Art

Conventionally, in an image forming apparatus such as a copier or a printer, a technique in which a neutralizing light source that neutralizes a surface potential on an image bearer such as a photoconductor drum or a photoconductor belt, is provided at a position downstream of a transfer position and upstream of a cleaning unit, rather than at a position downstream of the cleaning unit and upstream of a charging unit, so as to face the image bearer, has been widely used (see, for example, Japanese Patent No. 5327569, Japanese Laid-open Patent Publication No. 2011-112818, and Japanese Laid-open Patent Publication No. 2003-122065).

Specifically, in Japanese Patent No. 5327569, a neutralizing lamp (neutralizing light source) is provided at a position downstream of a transfer position in a rotation direction of a photoconductor drum (image bearer) and upstream of a cleaning device (cleaning unit) in the rotation direction of the photoconductor drum so as to face the photoconductor drum. The surface of the photoconductor drum is directly irradiated with neutralizing light emitted from the neutralizing lamp, and a surface potential on the photoconductor drum is neutralized.

Further, to reduce a defect such as light deterioration of a photoconductor drum due to the neutralizing light emitted from the neutralizing lamp, Japanese Patent No. 5327569 discloses a technique in which the light intensity of the neutralizing light emitted from the neutralizing lamp is changed in accordance with a timing of changing a transfer bias.

Meanwhile, Japanese Laid-open Patent Publication No. 2011-112818 and Japanese Laid-open Patent Publication No. 2003-122065 disclose techniques in which a first neutralizing light source is provided downstream of a cleaning unit and upstream of a charging unit so as to face a photoconductor drum (image bearer), and a second neutralizing light source is provided downstream of a transfer position and upstream of the cleaning unit so as to face the photoconductor drum.

In the conventional techniques, the surface of the image bearer (photoconductor drum) is directly irradiated with the neutralizing light; therefore, a defect such as acceleration of light deterioration of the image bearer occurs.

In this regard, in the technique described in Japanese Patent No. 5327569, the light intensity of the neutralizing light emitted by the neutralizing lamp is changed according to a timing of changing a transfer bias, and therefore, it is expected that a defect as described above is reduced to some extent. However, in the technique described in Japanese Patent No. 5327569, control of changing the light intensity of the neutralizing light may become complicated.

In view of the above, there is a need for an image forming apparatus capable of reducing a defect including acceleration of light deterioration of an image bearer due to neutralizing light emitted by a neutralizing light source, with a relatively simple configuration and control.

SUMMARY OF THE INVENTION

It is an object of the present invention to at least partially solve the problems in the conventional technology.

An image forming apparatus includes: an image bearer, which runs in a predetermined direction and on which a latent image is formed and developed and a toner image is borne; a transfer member that is arranged so as to come in contact with or face the image bearer to form a transfer position, and transfers the toner image borne on the image bearer to a recording medium conveyed to the transfer position; a cleaning unit that removes and collects, from the image bearer, untransferred toner that is attached to a surface of the image bearer without being transferred to the recording medium at the transfer position; a guide member that is arranged so as to face a non-transfer surface of the recording medium sent out from the transfer position and that guides conveyance of the recording medium; a neutralizing light source that irradiates a position downstream of the transfer position in a running direction of the image bearer and upstream of the cleaning unit in the running direction of the image bearer with neutralizing light which is incident on and reflected by the recording medium sent out from the transfer position and/or the guide member, to thereby neutralize a surface potential on the image bearer; and a shielding member that is arranged between the image bearer and the neutralizing light source, and that blocks light such that the image bearer is not irradiated directly with a part or whole of neutralizing light emitted from the neutralizing light source.

An image forming apparatus includes: an image bearer, which runs in a predetermined direction and on which a latent image is formed and developed and a toner image is borne; an intermediate transfer medium, which is arranged so as to come in contact with the image bearer to form a primary transfer nip and on which the toner image borne on the image bearer is transferred at the primary transfer nip; a cleaning unit that removes and collects, from the image bearer, untransferred toner that is attached to a surface of the image bearer without being transferred to the recording medium at the primary transfer nip; a neutralizing light source that irradiates a position downstream of the primary transfer nip in a running direction of the image bearer and upstream of the cleaning unit in the running direction of the image bearer with neutralizing light which is incident on and reflected by a surface of the intermediate transfer medium that has passed through the primary transfer nip, to thereby neutralize a surface potential on the image bearer; and a shielding member that is arranged between the image bearer and the neutralizing light source, and that blocks light such that the image bearer is not irradiated directly with a part or whole of neutralizing light emitted from the neutralizing light source.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiment

Figure 1:
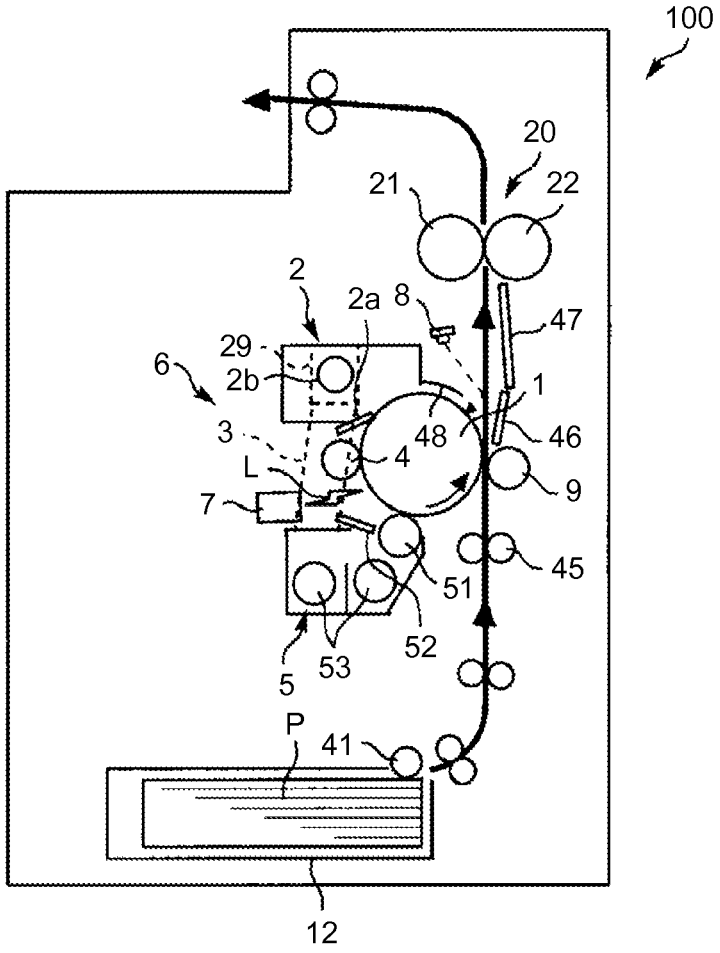
FIG. 1 is an entire configuration diagram of an image forming apparatus according to an embodiment of the present invention.

Exemplary embodiments of the present invention will be described in detail below with reference to the accompanying drawings. The same or equivalent components in the drawings are denoted by the same reference signs, and the same explanation will be simplified or omitted appropriately.

The entire configuration and operation of an image forming apparatus will be described below with reference to FIG. 1.

In FIG. 1, 100 denotes a printer as an image forming apparatus, 6 denotes a process cartridge (image formation unit) that forms a toner image (image) on the photoconductor drum 1, 7 denotes an exposure unit (writing unit) that irradiates the photoconductor drum 1 with exposure light L based on image information input from an input device, such as a personal computer, 8 denotes a neutralizing light source (neutralizing unit) that neutralizes a surface potential on the photoconductor drum 1, 9 denotes a transfer roller as a transfer member that transfers a toner image borne on the photoconductor drum 1 to a recording medium P conveyed to a transfer position, 12 denotes a paper feeding unit (paper feeding cassette) in which recording media P, such as transfer paper, are stored, 20 denotes a fixing device that fixes an unfixed image on the recording medium P, 21 denotes a fixing roller provided in the fixing device 20, 22 denotes a pressing roller provided in the fixing device 20, 45 denotes a registration roller (timing roller) that conveys the recording medium P toward a transfer position (transfer nip) at which the photoconductor drum 1 and the transfer roller 9 come in contact with each other, 46 denotes a transfer guide plate as a guide member that guides conveyance of the recording medium P after a transfer process, 47 denotes a fixing guide plate that guides the conveyance of the recording medium P before a fixing process, and 48 denotes a shielding member that restricts an optical path (light intensity) of neutralizing light emitted from the neutralizing light source 8.

Figure 2:
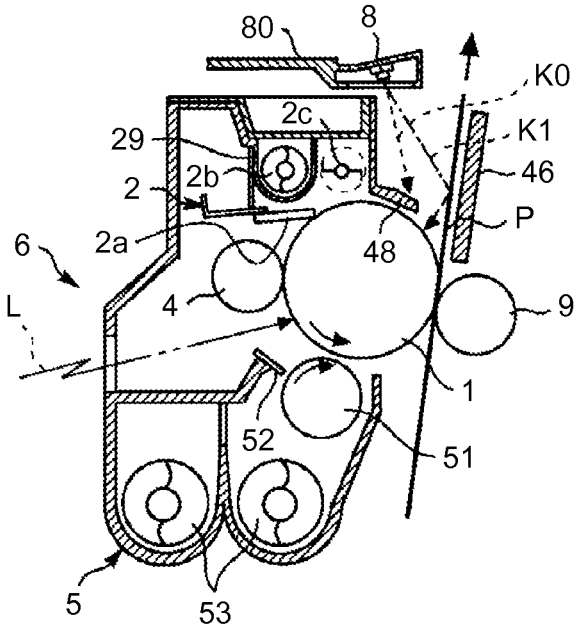
FIG. 2 is an enlarged configuration diagram of a part of an image formation unit.

With reference to FIG. 1 and FIG. 2, the process cartridge 6 is configured as a unit, in which the photoconductor drum 1 as the image bearer, a charging unit 4 (charging roller), a developing unit 5 (developing device), a cleaning unit 2 (cleaning device), and recycle toner paths 3 and 29 are integrated. The process cartridge 6 is removably (replaceably) mounted in the image forming apparatus main-body 100.

More specifically, the photoconductor drum 1 as the image bearer is a negatively-charged organic photoconductor, in which a photosensitive layer and the like is provided on a drum-shaped conductive support. Although illustration is omitted, in the photoconductor drum 1, an undercoating layer as an insulating layer, a charge generation layer as a photosensitive layer, and a charge transport layer are laminated in this order on the conductive support serving as a base layer. Further, the photoconductor drum 1 rotates (runs) counterclockwise in FIG. 1 by rotation drive of a driving motor (not illustrated).

The charging unit 4 is a charging roller, in which a middle resistance elastic layer covers an outer periphery of a conductive cored bar, and is in contact with the photoconductor drum 1. A power supply (not illustrated) applies a predetermined voltage (charging bias) to the charging unit 4, so that the surface of the opposing photoconductor drum 1 is uniformly charged.

The developing unit 5 (developing device) mainly includes a developing roller 51 facing the photoconductor drum 1, two developing conveying screws 53 arranged side by side with a partition member interposed therebetween, and a doctor blade 52 facing the developing roller 51. The developing roller 51 includes an inside magnet that is fixed and forms a magnetic pole on a circumferential surface of the developing roller, and a sleeve that rotates around the magnet. A plurality of magnetic poles are formed on the developing roller 51 (sleeve) by the magnet, so that developer is borne on the developing roller 51. The developing unit 5 contains two-component developer formed of carrier and toner. A toner container (containing new toner), which is removably mounted independent of the process cartridge 6, is connected to the upper part of the developing unit 5, although not illustrated in the drawings.

The developing unit 5 having the above configuration operates as described below.

The sleeve of the developing roller 51 rotates clockwise in FIG. 1. The developer borne on the developing roller 51 by the magnetic poles formed by the magnet moves on the developing roller 51 along with the rotation of the sleeve. At this time, the developer in the developing unit 5 is adjusted such that a ratio of the toner in the developer (a toner density) falls within a predetermined range (the toner is appropriately supplied from the toner container via a toner supply port (not illustrated)).

Thereafter, the toner supplied to the inside of developer containers is mixed and stirred with the developer by the two developing conveying screws 53, and is circulated through the two developer containers that are separated, by a partition member, from each other excluding both end portions in a width direction (movement in the direction normal to the sheets of FIG. 1 and FIG. 2). Then, the toner in the developer is adsorbed to the carrier by frictional charging with the carrier, and is borne on the developing roller 51 together with the carrier by a magnetic force formed on the developing roller 51.

The developer borne on the developing roller 51 is conveyed clockwise in FIG. 1, and reaches the position of the doctor blade 52. The amount of the developer on the developing roller 51 is optimized at this position, and the developer is further conveyed to a position facing the photoconductor drum 1 (a developing region). With the aid of an electric field formed in the developing region (an electric field formed by a developing bias applied to the developing roller 51 and a latent image potential on the photoconductor drum 1), the toner is adsorbed to the latent image formed on the photoconductor drum 1. Thereafter, the developer remaining on the developing roller 51 reaches a position over the developer containers along with the rotation of the sleeve, and is separated from the developing roller 51 at this position.

Meanwhile, the developing roller 51 and the developing conveying screws 53 in the developing unit 5 are rotated by receiving a driving force from a developing driving motor (not illustrated).

With reference to FIG. 1 and FIG. 2, the cleaning unit 2 includes a cleaning blade 2*a*, which comes in contact with the photoconductor drum 1 and removes untransferred toner attached to a surface of the photoconductor drum 1 (including attached substances, such as paper powder generated from the recording medium P, cohered untransferred toner (cohered toner), a discharge product generated on the photoconductor drum 1 during a discharge by the charging unit 4, and an additive added to the toner). The cleaning unit 2 further includes a stirring member 2*c* that stirs and conveys the untransferred toner removed and collected by the cleaning unit 2, and a conveying screw 2*b* that conveys the untransferred toner removed and collected by the cleaning unit 2 in the width direction (a direction normal to the sheet of FIG. 1 and FIG. 2).

The cleaning blade 2*a* is formed such that a plate-shaped blade body made of a rubber material such as urethane rubber, epichlorohydrin rubber, silicone rubber, or fluoro rubber is held by a holding plate, and is in contact with the surface of the photoconductor drum 1 at a predetermined angle and a predetermined pressure. Therefore, the untransferred toner attached to the photoconductor drum 1 is mechanically scraped off and collected into the cleaning unit 2. In the embodiment, the cleaning blade 2*a* comes in contact with the photoconductor drum 1 in the counter direction with respect to the running direction (rotation direction) of the photoconductor drum 1.

The stirring member 2*c* is formed such that a stirring portion is mounted on a rotation shaft portion, and rotates in a predetermined direction by receiving a driving force from a driving motor (not illustrated).

The conveying screw 2*b* is formed such that a screw portion is spirally wound around a rotation shaft portion, and rotates in a predetermined direction by receiving a driving force from a driving motor (not illustrated).

The untransferred toner collected by the cleaning unit 2 is supplied, as recycle toner, to the developing unit 5 through the recycle toner paths 3 and 29.

Specifically, a recycle toner path is formed of the conveying path 29 (a horizontal conveying unit), which is arranged in the upper part of the cleaning unit 2 (the process cartridge 6) and in which the conveying screw 2*b* is provided, and the fall path 3 that connects the conveying path 29 and the developing unit 5. The untransferred toner collected into the cleaning unit 2 is flowed into an inflow port formed at one end of the conveying path 29 in the width direction (a direction normal to the sheets of FIG. 1 and FIG. 2), is conveyed in the width direction (a rotation shaft direction) by the conveying screw 2*b* in the conveying path 29, and is flowed out toward the fall path 3 via an outflow port on the other end in the width direction. The untransferred toner flowed into the fall path 3 falls through the fall path 3 by own weight, is supplied to the developing unit 5 via a supply port, and is used as the recycle toner in the developing unit 5.

With reference to FIG. 1, operation of forming a normal image by the image forming apparatus 100 will be described below.

If an input device, such as a personal computer, transmits image information to the exposure unit 7 of the image forming apparatus 1, the exposure unit 7 emits exposure light L (laser light) based on the image information toward the photoconductor drum 1.

Meanwhile, the photoconductor drum 1 rotates in the direction of an arrow (counterclockwise). The surface of the photoconductor drum 1 is uniformly charged at the position facing the charging unit 4 (a charging process). Therefore, a charging potential (about −900 volts (V)) is formed on the photoconductor drum 1. Subsequently, the charged surface of the photoconductor drum 1 reaches an irradiation position for irradiation with the exposure light L. Then, a potential on a portion irradiated with the exposure light L reaches a latent image potential (about 0 V to −100 V), and an electrostatic latent image is formed on the surface of the photoconductor drum 1 (an exposure process). Specifically, a portion irradiated with the exposure light L on the surface of the photoconductor drum 1 serves as an image portion (an electrostatic latent image) where a latent image potential (an image portion potential) is formed, and other portions serve as a non-image portion (a background portion) where a charging potential (a non-image potential) is maintained.

Subsequently, the surface of the photoconductor drum 1 on which the electrostatic latent image is formed reaches the position facing the developing unit 5 (the developing roller 51). Then, the developing unit 5 supplies toner onto the photoconductor drum 1, so that the latent image on the photoconductor drum 1 is developed into a toner image (a developing process).

Thereafter, the surface of the photoconductor drum 1 after the developing process reaches the transfer nip (transfer position) formed with the transfer roller 9 serving as the transfer member. At the transfer nip formed with the transfer roller 9, the toner image formed on the photoconductor drum 1 is transferred to the recording medium P conveyed by a registration roller 45, by a transfer bias (a bias with the polarity opposite to the polarity of the toner) applied to the transfer roller 9 (a transfer process).

Then, the surface of the photoconductor drum 1 after the transfer process is neutralized with neutralizing light (light) emitted from the neutralizing light source 8 such that the surface potential is reset to approximately OV, and thereafter reaches the position facing the cleaning unit 2. At this position, the cleaning blade 2*a* mechanically removes untransferred toner (including other attached matters, such as paper powder or cohered toner) remaining on the photoconductor drum 1, and the untransferred toner is collected into the cleaning unit 2 (a cleaning process). Thus, a series of the image formation processes in the photoconductor drum 1 is completed.

The configuration and operation of the neutralizing light source 8 for neutralizing the surface potential on the photoconductor drum 1 will be described in detail later with reference to FIG. 2 for example.

Meanwhile, the recording medium P conveyed to the transfer nip (transfer position) between the photoconductor drum 1 and the transfer roller 9 is operated as described below.

First, the topmost one of the recording media P stored in the paper feeding unit 12 is fed toward a conveying path by a paper feeding roller 41.

Subsequently, the recording medium P reaches the position of the registration roller 45. The recording medium P that has reached the position of the registration roller 45 is conveyed toward the transfer nip (the transfer roller 9) at a synchronized timing so as to match with the position of the image formed on the photoconductor drum 1.

The recording medium P after the transfer process passes through the transfer nip (the transfer roller 9), and thereafter reaches the fixing device 20 through a conveying path formed by a transfer guide plate 46 and a fixing guide plate 47. The recording medium P that has reached the fixing device 20 is put into between the fixing roller 21 and the pressing roller 22, and the image is fixed by heat applied by the fixing roller 21 and pressure applied by the two members 21 and 22. The recording medium P on which the image is fixed is sent out from a nip (a fixing nip portion) between the fixing roller 21 and the pressing roller 22, and discharged out of the image forming apparatus main-body 100.

Thus, a series of the image forming processes is completed.

The characteristic configuration and operation of the image forming apparatus 100 of the embodiment will be described in detail below.

As described above with reference to FIG. 1 and FIG. 2, the image forming apparatus 100 of the embodiment includes the transfer roller 9 as the transfer member, the cleaning unit 2, and the transfer guide plate 46 as the guide member.

The transfer roller 9 as the transfer member transfers a toner image borne on the photoconductor drum 1 to the recording medium P conveyed to the transfer nip (transfer position) that is formed by contact with the photoconductor drum 1 (image bearer).

The cleaning unit 2 removes and collects, by the cleaning blade 2*a*, untransferred toner that is attached to the surface of the photoconductor drum 1 without being transferred to the recording medium P at the transfer nip (transfer position), from the photoconductor drum 1.

The transfer guide plate 46 is arranged so as to face a non-transfer surface (a back side opposite to a front side on which the transfer image is formed) of the recording medium P sent out from the transfer nip (transfer position), and functions as a guide member to guide the conveyance of the recording medium P after the transfer process.

With reference to FIG. 2, the neutralizing light source 8 is a light emitting diode (LED), and has an emitting surface (from which neutralizing light is emitted), which extends in the width direction so as to cover a range in the width direction of the photoconductor drum 1 (a direction normal to the sheet of FIG. 2). The neutralizing light source 8 neutralizes a surface potential on the photoconductor drum 1 after the transfer process and before the cleaning process, with neutralizing light whose optical path is limited by the shielding member 48 (mainly with neutralizing light reflected by the recording medium P and the transfer guide plate 46).

Specifically, the neutralizing light source 8 irradiates the position downstream of the transfer nip (transfer position) in the rotation direction of the photoconductor drum 1 (downstream in the running direction) and upstream of the cleaning unit 2 in the rotation direction of the photoconductor drum 1 (upstream in the running direction) with neutralizing light K1 which is incident on and reflected by the surface of the recording medium P sent out from the transfer nip and/or the surface of the transfer guide plate 46 (guide member), to thereby neutralize a surface potential on the photoconductor drum 1. The neutralizing light source 8 is fixed and held on a housing of a neutralizing unit 80. The neutralizing unit 80 is positioned and fixedly held on the image forming apparatus main-body 100 with a screw, independent of the process cartridge 6.

The shielding member 48 is arranged between the photoconductor drum 1 and the neutralizing light source 8, and also functions as a part of a case (made of a resin material colored in black) of the process cartridge 6 in the embodiment. The shielding member 48 blocks light such that the photoconductor drum 1 is not directly irradiated with a part or the whole of the neutralizing light emitted from the neutralizing light source 8.

As described above, in the embodiment, the shielding member 48 blocks most (or the whole) of light K0 that travels on an optical path for directly irradiating the photoconductor drum 1, in the neutralizing light (light) that is emitted and spread out to some extent in the emission direction from the emitting surface of the neutralizing light source 8, and light K1 that travels on an optical path so as to be incident on and reflected by the recording medium P and the transfer guide plate 46 is mainly used, as the neutralizing light, to irradiate the surface of the photoconductor drum 1. The reflectivity of the neutralizing light K1 with which the photoconductor drum 1 is irradiated indirectly by the reflection does not reach 100%, and therefore, the light intensity of the neutralizing light K1 is lower than the neutralizing light with which the photoconductor drum 1 is irradiated directly without reflection. Further, even if the photoconductor drum 1 is irradiated directly with some neutralizing light without being blocked by the shielding member 48, the amount of such neutralizing light is minute, so that the light intensity thereof is extremely low. The main neutralizing light K1 with which the photoconductor drum 1 is irradiated indirectly by the reflection has the adequate intensity to neutralize the surface potential on the photoconductor drum 1.

Therefore, the neutralizing light source 8 emits, to the surface of the photoconductor drum 1, neutralizing light with the requisite minimum intensity, which is not too strong or not too weak. Consequently, it is possible to surely suppress a defect, in which light deterioration (light-induced fatigue) of the photoconductor drum 1 is accelerated due to the neutralizing light emitted from the neutralizing light source 8, without causing a neutralizing failure.

Further, a neutralizing process performed by the neutralizing light source 8 as described above does not include complicated light intensity adjustment control, but is performed by simple ON/OFF control linked to the image formation process as will be described later. Therefore, it is possible to prevent a defect, in which neutralizing control becomes complicated.

Furthermore, in the embodiment, the surface potential on the photoconductor drum 1 is neutralized before the cleaning process, so that it is possible to perform a good cleaning process in a state in which an electrostatic adhesive force of the untransferred toner attached to the photoconductor drum 1 is reduced. In particular, when the untransferred toner on the photoconductor drum 1 is mechanically scraped off by using the cleaning blade 2*a* as in the embodiment, it is difficult to apply a voltage to the cleaning blade 2*a* so as to electrostatically scrape off the untransferred toner on the photoconductor drum 1; therefore, performing neutralization before the cleaning process is useful. Moreover, when the untransferred toner collected by the cleaning unit 2 is used as the recycle toner in the developing process as in the embodiment, a large amount of toner is oppositely charged as compared to the other cases, so that the electrostatic adhesive force of the toner increases when the toner is attached again as the untransferred toner to the photoconductor drum 1. Therefore, performing neutralization before the cleaning process is useful.

Furthermore, in the embodiment, direct irradiation of the surface of the photoconductor drum 1 with the neutralizing light before the cleaning process is limited, and the surface of the photoconductor drum 1 is neutralized mainly by being irradiated with the reflected neutralizing light. Therefore, the flexibility of the layout of the neutralizing light source 8 can be increased, and the size of the entire apparatus can be reduced. Specifically, regarding the arrangement position of the neutralizing light source 8 disposed based on the assumption that reflected light is used, restriction on the layout is reduced as compared to the arrangement position of a neutralizing light source disposed based on the assumption that direct light is used.

Moreover, the neutralizing light is reflected by using the recording medium P sent out from the nip portion or the existing transfer guide plate 46 without providing a dedicated reflector for reflecting the neutralizing light. Therefore, it is possible to prevent an increase in the size of the entire apparatus and an increase in cost.

Figure 3:
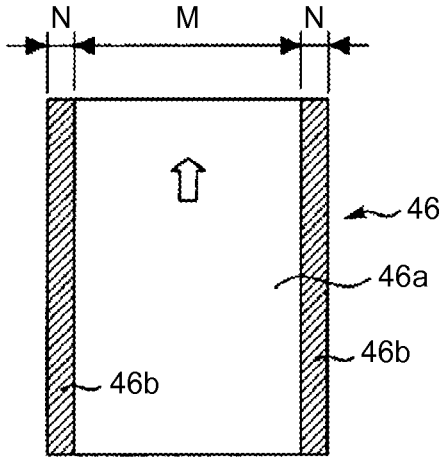
FIG. 3 is a schematic diagram illustrating a guide surface of a transfer guide plate.

With reference to FIG. 3, in the embodiment, the transfer guide plate 46 (guide member) is formed such that a range in the width direction (the direction perpendicular to the conveying direction of the recording medium P) corresponding to a sheet passing region M of the recording medium P of a maximum feedable size (for example, an A3 portrait recording medium P) is made of a material with a high optical reflectivity, and a range outside the above-described range in the width direction (range corresponding to no-sheet passing regions N) is made of a material with a low optical reflectivity.

Specifically, the transfer guide plate 46 according to the embodiment includes a high optical reflective portion 46*a* made of stainless steel (the color of the surface is silver that is the color of a material) that easily reflects light in the sheet passing region M, and includes low optical reflective portions 46*b* made of a resin material (the color of the surfaces is black) that does not easily reflect light in the no-sheet passing regions N on both ends in the width direction.

In this configuration, the both ends (the no-sheet passing regions) in the width direction of the photoconductor drum 1 are less likely to be irradiated with the neutralizing light reflected by the transfer guide plate 46, so that light deterioration is less likely to occur in these portions. Further, the center (a maximum sheet passing region) in the width direction of the photoconductor drum 1 is irradiated with the neutralizing light reflected by the high optical reflective portion 46*a* of the transfer guide plate 46, and is not irradiated with the neutralizing light diffusely reflected by the low optical reflective portion 46*b*. Therefore, it is possible to stably neutralize the maximum sheet passing region of the photoconductor drum 1 at a desired light intensity.

Further, in the embodiment, there are three modes for irradiating the surface of the photoconductor drum 1 with the reflected light of the neutralizing light emitted from the neutralizing light source 8 in the series of image forming processes (image formation processes), which will be described below.

As a first mode, the neutralizing light emitted from the neutralizing light source 8 is reflected only by the transfer guide plate 46 (a state in which the recording medium P is not passing as illustrated in FIG. 3), and the surface of the photoconductor drum 1 is irradiated with the reflected neutralizing light. Examples of this case include a case of neutralizing the surface of the photoconductor drum 1 corresponding to an interval between sheets during continuous sheet feeding, and a case of neutralizing the surface of the photoconductor drum 1 corresponding to a non-image portion before the recording medium P reaches the transfer nip. In this case, a charging potential (non-image portion potential) on the photoconductor drum 1 is surely neutralized by neutralizing light, which is reflected by the transfer guide plate 46 (the high optical reflective portion 46*a*) and which has a relatively high light intensity.

Figure 4A:
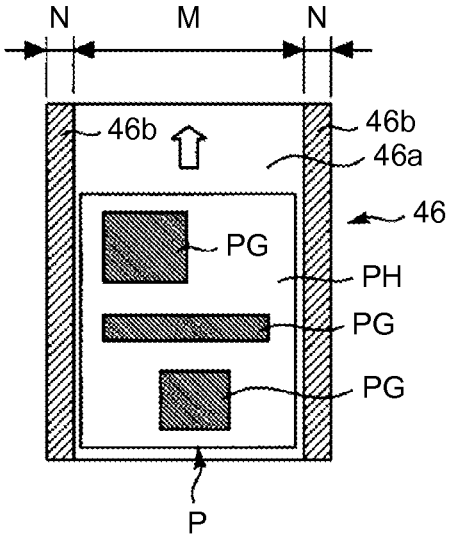
FIG. 4A is a schematic diagram illustrating a state in which a large-size sheet passes by the transfer guide plate.

As a second mode, the neutralizing light emitted from the neutralizing light source 8 is reflected only by the recording medium P, and the surface of the photoconductor drum 1 is irradiated with the reflected neutralizing light. Examples of this case include, as illustrated in FIG. 4A, a case of neutralizing the surface of the photoconductor drum 1 at a timing at which the recording medium P of the maximum size passes by the surface of the transfer guide plate 46. In this case, a charging potential (non-image portion potential) on the photoconductor drum 1 is surely neutralized by neutralizing light, which is reflected by a non-image portion PH of the recording medium P after the transfer process (a portion in which a toner image is not transferred and a background of the recording medium P is maintained, that is, in which the degree of whiteness is high) and which has a relatively high light intensity. In contrast, a latent image potential (image portion potential) on the photoconductor drum 1 is irradiated with neutralizing light, which is reflected by image portions PG of the recording medium P after the transfer process (portions in which toner images are transferred, that is, in which the degree of whiteness is low) and which has a relatively low light intensity; however, the absolute value of the latent image potential is naturally small and the latent image potential can fully be neutralized at a low light intensity; therefore, this portion can be surely neutralized similarly to the portion in which the charging potential is formed (a neutralizing failure does not occur).

Figure 4B:
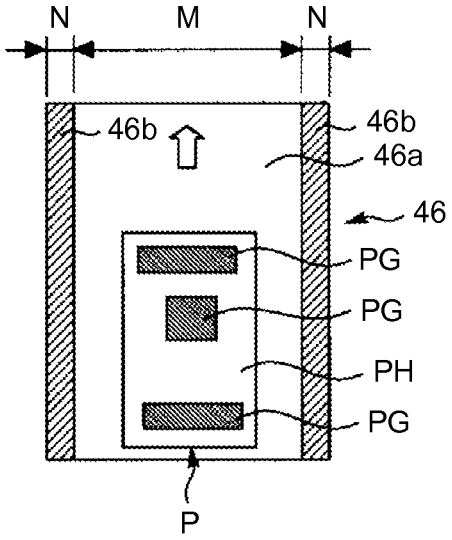
FIG. 4B is a schematic diagram illustrating a state in which a small-size sheet passes by the transfer guide plate.

As a third mode, the neutralizing light emitted from the neutralizing light source 8 is reflected by both of the recording medium P and the transfer guide plate 46, and the surface of the photoconductor drum 1 is irradiated with the reflected neutralizing light. Examples of this case include, as illustrated in FIG. 4B, a case of neutralizing the surface of the photoconductor drum 1 at a timing at which the recording medium P of a size smaller than the maximum sheet passing region M passes by the surface of the transfer guide plate 46. In this case, a charging potential (non-image portion potential) on the photoconductor drum 1 is surely neutralized by neutralizing light, which is reflected by the non-image portion PH of the recording medium P after the transfer process and the transfer guide plate 46 exposed at the both ends in the width direction of the recording medium P and which has a relatively high light intensity. In contrast, a latent image potential (image portion potential) on the photoconductor drum 1 is irradiated with neutralizing light, which is reflected by the image portions PG of the recording medium P after the transfer process and which has a relatively low light intensity; however, the absolute value of the latent image potential is naturally small and the latent image potential can fully be neutralized at a low light intensity: therefore, this portion can be surely neutralized similarly to the portion in which the charging potential is formed (a neutralizing failure does not occur).

In this manner, according to the configuration of the embodiment, it is possible to uniformly and accurately neutralize the surface potential on the photoconductor drum 1 irrespective of the size of the recording medium P or the timing at which the recording medium P passes through the transfer nip.

Further, in the embodiment, the neutralizing light source 8 is controlled so as to be always in the ON state while the image formation process is performed on the surface of the photoconductor drum 1 (image bearer).

Figure 5:
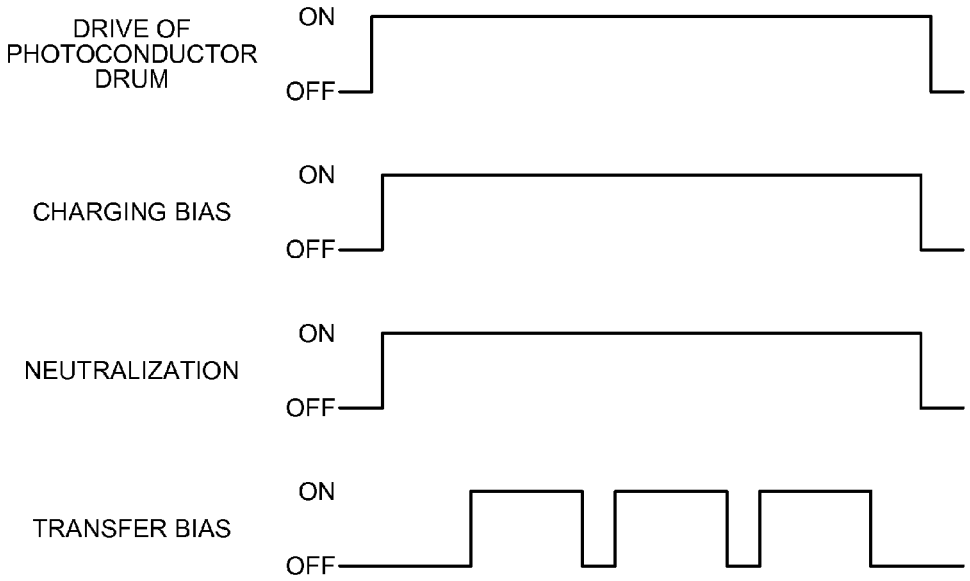
FIG. 5 is a timing diagram illustrating an example of control in the image formation unit.

FIG. 5 is a timing diagram illustrating an example of control in the image formation unit when image forming operation is performed by continuously feeding three recording media P. As illustrated in FIG. 5, a charging bias is applied to the charging unit 4 so as to be approximately synchronized with a timing at which the driving motor starts to rotate the photoconductor drum 1 in accordance with the start of an image formation process, and the neutralizing light source 8 is shifted from the Off state to the ON state. Then, a transfer bias is applied to the transfer roller 9 in synchronization with a timing at which the recording medium P passes through the transfer nip (a timing at which the transfer process is performed). Thereafter, application of the charging bias to the charging unit 4 is stopped so as to be approximately synchronized with a timing at which the driving motor stops the rotation of the photoconductor drum 1 in accordance with the termination of the image formation process, and the neutralizing light source 8 is switched from the ON state to the OFF state.

In this manner, the neutralizing light source 8 of the embodiment is controlled by simple ON/OFF control without performing complicated light intensity adjustment control. Therefore, a control failure or the like is less likely to occur.

Incidentally, in the embodiment, a transfer bias is not applied to the transfer roller 9 at the time of a non-transfer process, such as at a timing of an interval between sheets during continuous sheet feeding, in order to prevent a damage of the photoconductor drum 1 due to the contact between the transfer roller 9 applied with the transfer bias and the photoconductor drum 1. In contrast, if a damage as described above is negligible, it is possible to apply a transfer bias to the transfer roller 9 even at the time of the non-transfer process.

Figure 6:
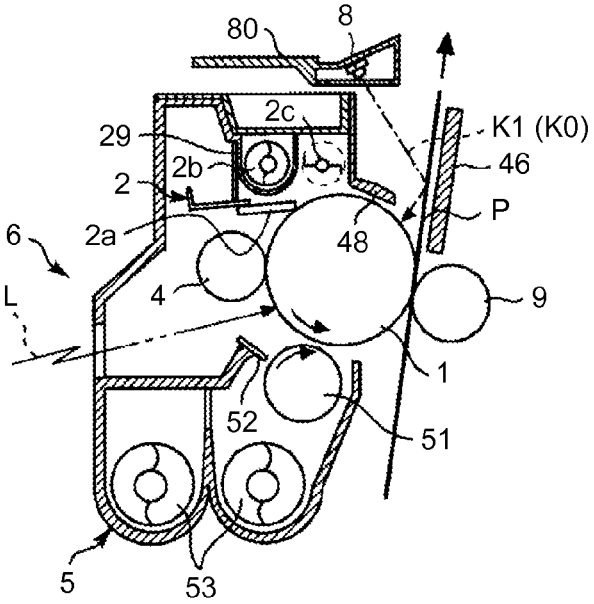
FIG. 6 is an enlarged configuration diagram of a part of an image formation unit according to a modification.

Further, as illustrated in FIG. 2, in the embodiment, the neutralizing light source 8 is arranged such that the neutralizing light K0 (light) that travels on the optical axis of the neutralizing light source 8 is blocked by the shielding member 48. Specifically, the shielding member 48 is arranged so as to block the optical axis (a portion with the maximum light intensity) of the neutralizing light source 8, where the optical axis extends in a direction in which the surface of the photoconductor drum 1 is irradiated. In other words, the neutralizing light source 8 is not arranged such that the optical axis extends toward the transfer guide plate 46 (or the recording medium P sent out from the transfer nip) as illustrated in FIG. 6, but is arranged such that the optical axis extends toward the surface of the photoconductor drum 1 and is blocked by the shielding member 48.

In this configuration, it is possible to irradiate the surface of the photoconductor drum 1 with the neutralizing light with the requisite minimum light intensity, which is not too strong or not too weak, from the neutralizing light source 8. The inventors of the disclosed technique have performed experiments and evaluated the degree of light deterioration (light-induced fatigue) of the photoconductor drum 1 and presence or absence of an abnormal image (afterimage) due to a neutralizing failure by using the image forming apparatus 100 (the neutralizing light source 8 illustrated in FIG. 2) of the embodiment, and confirmed that preferred results are obtained regarding the both.

Further, as illustrated in FIG. 2, in the embodiment, the neutralizing light source 8 is arranged such that the emitting surface from which the neutralizing light is emitted faces downward in the direction of gravity. Specifically, in the neutralizing light source, the emitting surface is arranged on the bottom surface so as to face downward instead of facing upward or sideways.

Therefore, a foreign object, such as toner or paper powder, floating near the emitting surface of the neutralizing light source 8 is less likely to adhere to the emitting surface (is likely to fall even when the foreign object is attached), so that it is possible to prevent a defect in which the neutralizing function is reduced due to dirt on the emitting surface of the neutralizing light source 8.

As described above, in the embodiment, the neutralizing light source 8 is configured such that the neutralizing light emitted directly toward the photoconductor drum 1 (the image bearer) is limited by the shielding member 48, and the surface potential on the photoconductor drum 1 is neutralized after the transfer process and before the cleaning process with the neutralizing light that is incident on and reflected by the recording medium P sent out from the transfer nip portion (transfer position) and/or the transfer guide plate 46 (guide member) that guides the recording medium P after the transfer process. Therefore, it is possible to reduce a defect such as acceleration of light deterioration of the photoconductor drum 1 due to the neutralizing light emitted from the neutralizing light source 8, with a relatively simple configuration and control.

Incidentally, in the embodiment, the disclosed technique is applied to the monochrome image forming apparatus 100 that includes the single photoconductor drum 1 as an image formation unit. However, as illustrated in FIG. 7, it is of course possible to apply the disclosed technique to a color image forming apparatus including an image formation unit 60, in which a plurality of photoconductor drums 1Y, 1M, 1C, and 1K corresponding to toner of different colors are arranged so as to face an intermediate transfer belt 38 serving as an intermediate transfer medium.

Figure 7:
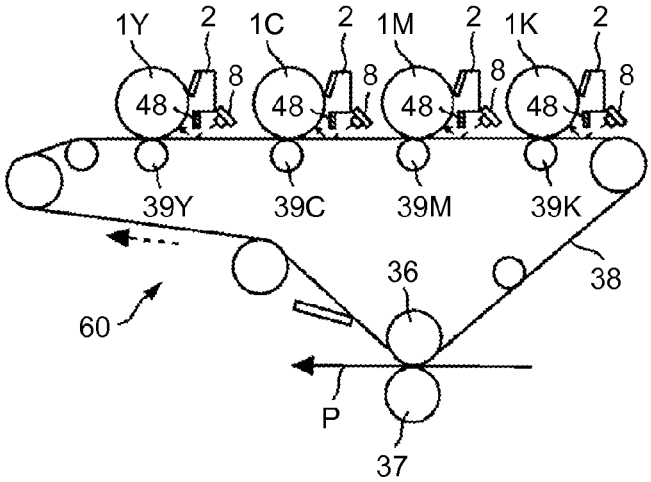
FIG. 7 is a configuration diagram illustrating main parts of an image forming apparatus according to another embodiment.

Specifically, FIG. 7 is a configuration diagram illustrating main parts of a color image forming apparatus that includes, as the image formation unit 60, a plurality of photoconductor drums 1Y, 1M, 1C, and 1K corresponding to toner of different colors, the intermediate transfer belt 38 as an intermediate transfer medium, and primary transfer rollers 39Y, 39M, 39C, and 39K as transfer members. In FIG. 7, the configurations of the components other than the image formation unit 60 in the image forming apparatus are approximately the same as those of the embodiment illustrated in FIG. 1, except that the conveying direction of the recording medium P is not an approximately vertical direction but an approximately horizontal direction, and therefore, illustration and explanation thereof will be omitted.

The four primary transfer rollers 39Y, 39M, 39C, and 39K (transfer members) and the photoconductor drums 1Y, 1M, 1C, and 1K sandwich the intermediate transfer belt 38, respectively, so that primary transfer nips are formed. A primary transfer voltage (primary transfer bias) with the polarity opposite to the polarity of the toner is applied to each of the primary transfer rollers 39Y, 39M, 39C, and 39K.

The intermediate transfer belt 38 runs in a direction of a dashed-line arrow, and sequentially passes through the primary transfer nips at the primary transfer rollers 39Y, 39M, 39C, and 39K. Accordingly, toner images of the respective colors formed on the photoconductor drums 1Y, 1M, 1C, and 1K (which are formed through the charging process, the exposure process, and the developing process, similarly to the embodiment) are superimposed on one another by primary transfer on the intermediate transfer belt 38.

Subsequently, the intermediate transfer belt 38 (image bearer) on which the toner images of the respective colors are transferred in a superimposed manner reaches the position facing a secondary transfer roller 37. At this position, a transfer opposing roller 36 and the secondary transfer roller 37 sandwich the intermediate transfer belt 38 and form a secondary transfer nip. The toner images of the four colors formed on the intermediate transfer belt 38 are transferred to the recording medium P conveyed to the position of the secondary transfer nip.

Then, as illustrated in FIG. 7, a developing unit (not illustrated), a charging unit, the cleaning unit 2, the neutralizing light source 8, and the shielding member 48 are arranged for each of the photoconductor drums 1Y, 1M, 1C, and 1K, similarly to the configuration illustrated in FIG. 2. The cleaning unit 2 in this example removes and collects, from each of the photoconductor drums 1Y, 1M, 1C, and 1K, untransferred toner that is attached to the surface of each of the photoconductor drums 1Y, 1M, 1C, and 1K without being transferred to the intermediate transfer belt 38 at the primary transfer nip. Further, the neutralizing light source 8 irradiates a position downstream of each of the primary transfer nips in the running direction of the photoconductor drums 1Y, 1M, 1C, and 1K and upstream of each of the cleaning units 2 in the running direction of the photoconductor drums 1Y, 1M, 1C, and 1K with neutralizing light which is incident on and reflected by the surface of the intermediate transfer belt 38 that has passed through each of the primary transfer nips, to thereby neutralize a surface potential on each of the photoconductor drums 1Y, 1M, 1C, and 1K. Furthermore, the shielding member 48 is arranged between each of the photoconductor drums 1Y, 1M, 1C, and 1K and each of the neutralizing light sources 8, and blocks light such that each of the photoconductor drums 1Y, 1M, 1C, and 1K is not irradiate directly with a part or the whole of the neutralizing light emitted from each of the neutralizing light sources 8.

Even in this case, the same advantageous effects as those of the embodiment can be obtained. In particular, in the example in FIG. 7, the neutralizing light emitted from each of the neutralizing light sources 8 is incident on and reflected by the intermediate transfer belt 38, and thereafter each of the photoconductor drums 1Y, 1M, 1C, and 1K is irradiated with the reflected neutralizing light. Therefore, it is important to adjust the color of a surface layer of the intermediate transfer belt 38 to obtain a desired reflectivity with respect to the incident neutralizing light.

Further, while the photoconductor drum 1 (image bearer), the charging unit 4, the developing unit 5, the cleaning unit 2, and the recycle toner paths 3 and 29 are integrated into the process cartridge 6 in the embodiment, the photoconductor drum (image bearer), the charging unit, the developing unit, the cleaning unit, and the recycle toner paths may be configured as independent units that are removably (replaceably) mounted in the image forming apparatus main-body.

Meanwhile, the "process cartridge" is defined as a unit, in which at least one of the charging unit that charges the image bearer, the developing unit (developing device) that develops a latent image formed on the image bearer, and the cleaning unit (cleaning device) that cleans the image bearer is integrated with the image bearer, and which is removably mounted in the image forming apparatus main-body.

Furthermore, while the disclosed technique is applied to the image forming apparatus 100 that supplies, as recycle toner, the untransferred toner collected by the cleaning unit 2 to the developing unit 5 in the embodiment, it is of course possible to apply the disclosed technology to an image forming apparatus that does not supply the untransferred toner collected by the cleaning unit to the developing unit as the recycle toner.

Moreover, while the transfer roller 9 arranged so as to come in contact with the photoconductor drum 1 to form a transfer position is used as the transfer member in the embodiment, a transfer device (wire transfer device) of a corona discharge system arranged so as to face the photoconductor drum 1 to form a transfer position may be used as the transfer member. However, if the transfer device of the corona discharge system is used, the posture of the recording medium P sent out from the transfer position is less stable than in the case of using the transfer roller 9 forming a transfer nip. Therefore, it becomes difficult to reflect the neutralizing light by the surface of the recording medium P and irradiate a desired position on the photoconductor drum 1.

Furthermore, while the disclosed technique is applied to the image forming apparatus 100 that includes the cleaning unit 2 with the cleaning blade 2*a* in the embodiment, it may be possible to apply the disclosed technique to an image forming apparatus in which a developing unit is configured to function also as a cleaning unit (see, for example, Japanese Laid-open Patent Publication No. 05-142932). In this case, the developing unit located downstream of the charging unit and upstream of the transfer position functions as the cleaning unit, and the surface of the image bearer is irradiated with the neutralizing light reflected by a recording medium or a guide member at a position downstream of and near the transfer position, similarly to the embodiment.

Even in this case, the same advantageous effects as those of the embodiment can be obtained.

According to an embodiment, it is possible to provide an image forming apparatus capable of reducing a defect such as acceleration of light deterioration of an image bearer due to neutralizing light emitted from a neutralizing light source, with a relatively simple configuration and control.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image bearer, which runs in a predetermined direction and on which a latent image is formed and developed and a toner image is borne;

a transfer member that is arranged so as to come in contact with or face the image bearer to form a transfer position, and transfers the toner image borne on the image bearer to a recording medium conveyed to the transfer position;

a cleaning unit that removes and collects, from the image bearer, untransferred toner that is attached to a surface of the image bearer without being transferred to the recording medium at the transfer position;

a guide member that is arranged so as to face a non-transfer surface of the recording medium sent out from the transfer position and that guides conveyance of the recording medium;

a neutralizing light source that irradiates a position downstream of the transfer position in a running direction of the image bearer and upstream of the cleaning unit in the running direction of the image bearer with neutralizing light which is incident on and reflected by the recording medium sent out from the transfer position and/or the guide member, to thereby neutralize a surface potential on the image bearer; and a shielding member that is arranged between the image bearer and the neutralizing light source, and that blocks light such that the image bearer is not irradiated directly with a part or whole of neutralizing light emitted from the neutralizing light source.

2. The image forming apparatus according to claim 1, wherein the transfer member is a transfer roller that comes in contact with the image bearer and forms a transfer nip as the transfer position.

3. The image forming apparatus according to claim 1, wherein the guide member is formed such that the guide member is made of a material with a high optical reflectivity in a range in a width direction corresponding to a sheet passing region of a recording medium of a maximum feedable size, and the guide member is made of a material with a low optical reflectivity in a range outside the range corresponding to the sheet passing region in the width direction.

4. The image forming apparatus according to claim 1, wherein the neutralizing light source is arranged such that neutralizing light that travels on an optical axis of the neutralizing light source is blocked by the shielding member.

5. The image forming apparatus according to claim 1, wherein the neutralizing light source is arranged such that an emitting surface from which the neutralizing light is emitted faces downward in a direction of gravity.

6. The image forming apparatus according to claim 1, wherein the cleaning unit includes a cleaning blade that comes in contact with the image bearer.

7. The image forming apparatus according to claim 1, further comprising:

a developing unit that stores therein toner and develops the latent image formed on the image bearer into the toner image; and a recycle toner path that supplies, as recycle toner, the untrasferred toner collected by the cleaning unit to the developing unit.

8. The image forming apparatus according to claim 1, wherein the neutralizing light source is controlled so as to be always in an ON state while an image formation process is performed on the surface of the image bearer.

9. An image forming apparatus comprising:

an image bearer, which runs in a predetermined direction and on which a latent image is formed and developed and a toner image is borne;

an intermediate transfer medium, which is arranged so as to come in contact with the image bearer to form a primary transfer nip and on which the toner image borne on the image bearer is transferred at the primary transfer nip;

a cleaning unit that removes and collects, from the image bearer, untransferred toner that is attached to a surface of the image bearer without being transferred to the recording medium at the primary transfer nip;

a neutralizing light source that irradiates a position downstream of the primary transfer nip in a running direction of the image bearer and upstream of the cleaning unit in the running direction of the image bearer with neutralizing light which is incident on and reflected by a surface of the intermediate transfer medium that has passed through the primary transfer nip, to thereby neutralize a surface potential on the image bearer; and a shielding member that is arranged between the image bearer and the neutralizing light source, and that blocks light such that the image bearer is not irradiated directly with a part or whole of neutralizing light emitted from the neutralizing light source.

10. The image forming apparatus according claim 9, wherein the neutralizing light source is arranged such that neutralizing light that travels on an optical axis of the neutralizing light source is blocked by the shielding member.

11. The image forming apparatus according to claim 9, wherein the neutralizing light source is arranged such that an emitting surface from which the neutralizing light is emitted faces downward in a direction of gravity.

12. The image forming apparatus according to claim 9, wherein the cleaning unit includes a cleaning blade that comes in contact with the image bearer.

13. The image forming apparatus according to claim 9, further comprising:

a developing unit that stores therein toner and develops the latent image formed on the image bearer into the toner image; and a recycle toner path that supplies, as recycle toner, the untransferred toner collected by the cleaning unit to the developing unit.

14. The image forming apparatus according to claim 9, wherein the neutralizing light source is controlled so as to be always in an ON state while an image formation process is performed on the surface of the image bearer.

* * * * *